US006421016B1

(12) United States Patent
Phillips et al.

(10) Patent No.: US 6,421,016 B1
(45) Date of Patent: Jul. 16, 2002

(54) ANTENNA SYSTEM WITH CHANNELED RF CURRENTS

(75) Inventors: James P. Phillips, Lake in the Hills; Eric L. Krenz, Crystal Lake; Andrew A. Efanov, Harvard; Narendra Pulimi, Schaumburg, all of IL (US)

(73) Assignee: Motorola, Inc., Schaumburg, IL (US)

( * ) Notice: Subject to any disclaimer, the term of this patent is extended or adjusted under 35 U.S.C. 154(b) by 89 days.

(21) Appl. No.: 09/694,247

(22) Filed: Oct. 23, 2000

(51) Int. Cl.[7] ..... H01Q 1/24

(52) U.S. Cl. ..... 343/702; 343/846; 343/895; 455/575

(58) Field of Search ..... 343/702, 790, 343/846, 847, 848, 895, 841; 455/90, 575; H01Q 1/24

(56) References Cited

U.S. PATENT DOCUMENTS 4,352,109 A 9/1982 Reynolds et al. ..... 343/792
4,518,968 A 5/1985 Hately ..... 343/802
4,700,194 A 10/1987 Ogawa et al. ..... 343/700 MS
4,868,576 A 9/1989 Johnson, Jr. ..... 343/702
5,257,033 A 10/1993 Roche ..... 343/742
5,612,705 A 3/1997 Openlander ..... 343/790

*Primary Examiner*—Michael C. Wimer
(74) *Attorney, Agent, or Firm*—Brian M. Mancini

(57) ABSTRACT

An improved antenna system to channel counterpoise currents for an unbalanced antenna such as a helical monopole. A first conductor, or ground resonator, is coupled to a ground connection near the antenna and is located distally from a user to reduce electromagnetic exposure. The first conductor presents a low impedance path at an operating frequency of the antenna such that RF currents are attracted onto the first conductor. A second conductor, such as a printed circuit board or user interface circuitry, is also coupled to the ground connection of the first conductor. The second conductor presents a high impedance path at the operating frequency of the antenna such that RF currents are diverted away from the second conductor which is held closer to a user than the first conductor.

20 Claims, 5 Drawing Sheets

ANTENNA SYSTEM WITH CHANNELED RF CURRENTS

FIELD OF THE INVENTION

The present invention relates generally to radio antennas, and more particularly to an antenna for portable communication devices.

BACKGROUND OF THE INVENTION

Wireless handheld communication devices, such as cellular telephones, transmit RF power and are carefully scrutinized for the level of RF radiation to which they expose a user. The highest level of RF exposure is most often from RF currents flowing on or in the metal parts of the housing of the device and not on the antenna. Prior art methods of reducing or eliminating the RF currents of the housing have resulted in the use of large and unwieldy antennas or large RF currents that cause large reactive near fields of the antenna such that it then becomes the dominant source of unacceptable RF exposure. In either case, the size of the antenna and phone increases.

The size of portable communication devices has historically been set by the size of the enclosed electronics and the battery. Consumer and user demand has continued to push a dramatic reduction in the size of communication devices. As a result, during transmission, the antenna induces higher RF currents onto the small housing, chassis or printed circuit boards of the communication device in an uncontrolled manner. These RF currents are often dissipated rather than efficiently contributing to the radiation of RF communication signals. The dissipation of RF power can detrimentally affect the circuitry on very small units. Moreover, this loss of power lowers the quality of communication and reduces battery life of the device.

Another problem experienced by prior art antennas is the radiation degradation experienced when the portable radio is held and used by the operator. Continuous advances in electronics and battery technology have allowed a dramatic reduction in size so that the performance of the antenna is poor due to it being enclosed by a user's hand.

The metallic portion of the housing of the portable radio is typically used as the ground or counterpoise for the antenna and allows RF currents to flow in an uncontrolled manner. Unacceptable radiation degradation is typically experienced when an operator places their hand around the housing, thereby causing degradation in the radiation efficiency of the ground radiator.

Accordingly, what is needed is a communication device having a controlled flow of RF currents within the housing of the device so as to remove them from the proximity of the user. It would also be beneficial to provide housing current reduction without the need for a large antenna so as to be more accommodating to a user. Additionally, it would be an advantage to accomplish these needs without radiation degradation, decreased battery life, or increased size or cost of the communication device.

DETAILED DESCRIPTION OF THE PREFERRED EMBODIMENTS

Figure 1:
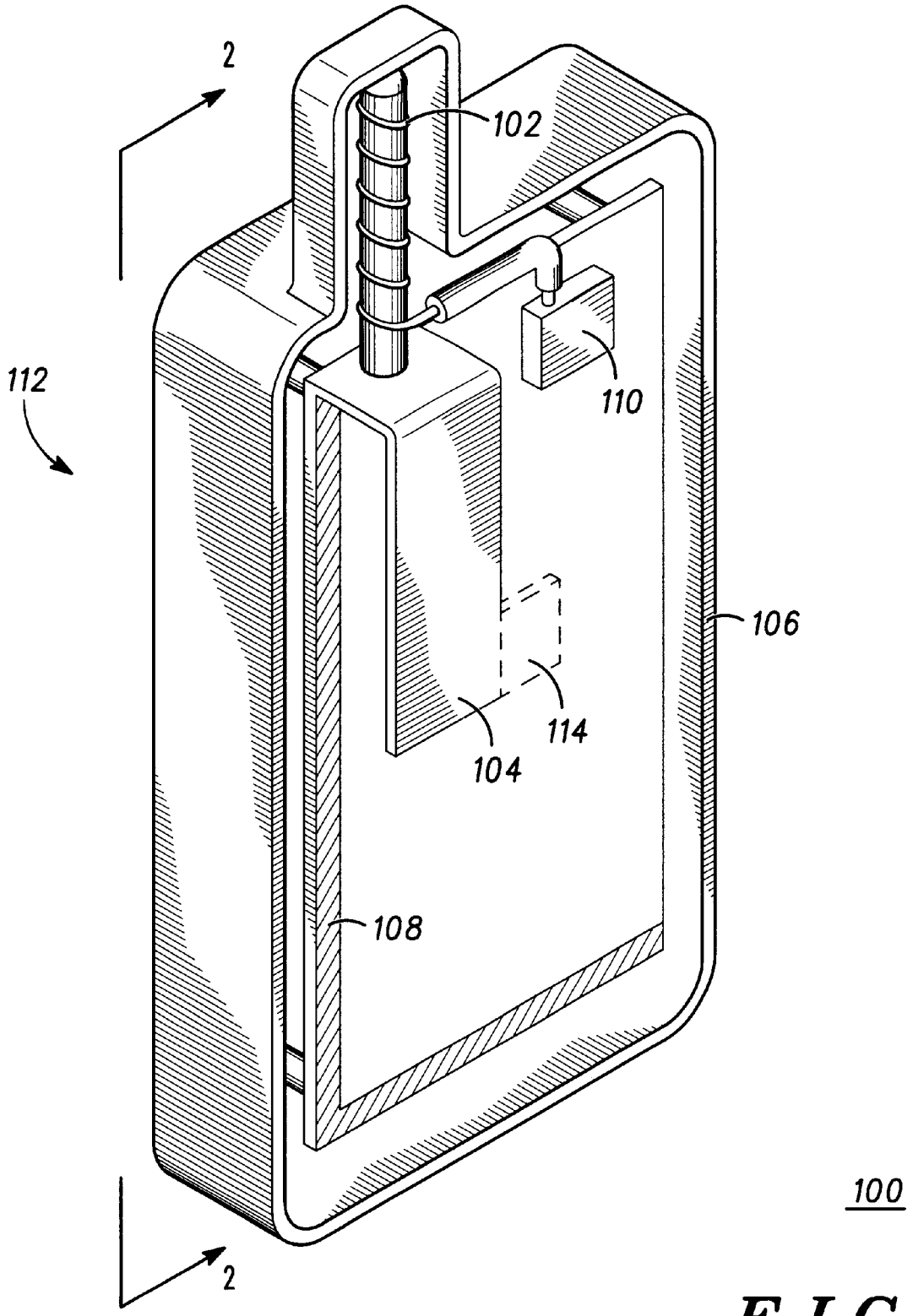
FIG. 1 is a perspective cross-sectional view of a communication device with an antenna system, in accordance with the present invention.

The present invention provides a radio communication device configured to control the flow of RF currents within a housing of the device so as to remove them from the proximity of the user. This can be accomplished in conjunction with the use of a small, fixed antenna which is more accommodating to a user. In addition, the present invention improves antenna efficiency by channeling more of the RF current to the intended antenna system and away from those portions of the chassis or housing that are proximate to the user, thereby increasing battery life, without increased size or cost of the communication device.

As portable communication technology has advanced, antenna efficiency and electromagnetic exposure has become an issue in two-way (transmit) hand-held wireless communication products. Smaller, hand-held, wireless communication products are demanded by the market and meeting antenna efficiency and electromagnetic exposure requirements are more difficult. The present invention advantageously provides increased antenna efficiency while also decreasing electromagnetic exposure to a user. In addition, this invention allows products to be reduced in size without compromising performance.

The invention will have application apart from the preferred embodiments described herein, and the description is provided merely to illustrate and describe the invention and it should in no way be taken as limiting of the invention. While the specification concludes with claims defining the features of the invention that are regarded as novel, it is believed that the invention will be better understood from a consideration of the following description in conjunction with the drawing figures, in which like reference numerals are carried forward. As defined in the invention, a radiotelephone is a communication device that communicates information to a base station using electromagnetic waves in the radio frequency range. In general, the radiotelephone is portable and, when used, is typically held up to a person's head, next to their ear.

The concept of the present invention can be advantageously used on any electronic product requiring the transceiving of RF signals. Preferably, the radiotelephone portion of the communication device is a cellular radiotelephone adapted for personal communication, but may also be a pager, cordless radiotelephone, or a personal communication service (PCS) radiotelephone. The radiotelephone portion may be constructed in accordance with an analog communication standard or a digital communication standard. The radiotelephone portion generally includes a radio frequency (RF) transmitter, a RF receiver, a controller, an antenna, a battery, a duplex filter, a frequency synthesizer, a signal processor, and a user interface including at least one of a keypad, display, control switches, and a microphone. The radiotelephone portion can also include a paging receiver. The electronics incorporated into a cellular phone, two-way radio or selective radio receiver, such as a pager, are well known in the art, and can be incorporated into the communication device of the present invention.

FIG. 1 illustrates a communication device according to the present invention. By way of example only, the communication device is embodied in a cellular phone having a conventional cellular radio transceiver circuitry, as is known in the art, and will not be presented here for simplicity. The cellular telephone, includes conventional cellular phone hardware (also not represented for simplicity) such as processors and user interfaces that are integrated in a compact housing, and further includes an antenna system, in accordance with the present invention. Each particular wireless device will offer opportunities for implementing this concept and the means selected for each application. A series of specific embodiments are presented, ranging from the abstract to the practical, which illustrate the application of the basic precepts of the invention.

In the present invention, impedances (reactive and/or resistive devices) are incorporated into the radio chassis which "steer" RF currents by either attracting them with a low impedance or repelling them with a high impedance. Resistive devices dissipate RF power, so the most power efficient approach is to use reactive devices that are either capacitive or inductive. Actual or artificial transmission line devices are preferred, and a quarter-wavelength resonator is the most useful.

A radio chassis consists of several parts with conductive portions (PC board, battery, case, shields, etc.) that are often referred to as the ground and all devices connected to it through a ground connection. This invention defines the interconnection of these parts or additional parts such that transmission line devices are created which "steer" the RF currents on the radio chassis. Different embodiments will be included as specific examples. Each of which provides an intentional modification of, or addition to, the conducting and non-conducting structure of a communication device for the purpose of diverting RF currents away from dissipating media such as the user's head, limb or body. The preferred method is to use an existing structure such as the battery pack by carefully choosing the location, connection point and conductive configuration of the battery pack to make it a resonant counterpoise to the antenna. Additional tuning elements may have to be added if the conductive structure cannot be modified sufficiently to achieve resonance. Further, modification of the radio chassis and/or conductive case, to make it non-resonant or more anti-resonant, lowers RF currents on the chassis. A preferred configuration is a quarter-wavelength, shorted choke with the open end located in the path of the RF currents to be reduced.

In practice, the present invention consists of two types of devices that are either added or incorporated into the RF chassis and/or conductive parts of the communication device 100 to divert counterpoise currents of an unbalanced antenna 102. In a typical application, the antenna 102 extends outwardly from the housing 106 and is electrically coupled to transceiver circuitry 110 of the device 100. However, the antenna can also be completely contained within the housing. The transceiver circuitry 110 operates in any of the well known modes of operation for radio transceivers.

The first device to divert currents is a first conductor 104 that presents a low impedance to RF currents and thusly attracts them onto itself. In operation, this first device is located distally from all dissipating media such as the user's head or hand. Preferably, the first conductor is located near an upper, rear side of a housing 106 of the device 100 opposite from a front surface 112 thereof. In this position, the first conductor would be substantially distant from a user's head placed near the front of the device and the users hand which will cover the bottom of the back of the device. The first conductor 104 is made to have a low electrical impedance, and preferably a high susceptance, at the frequencies of operation of the radiotelephone by one of several means used alone or in combination. These means include: the use of a large conductors, e.g. wide straps which have low inductance; a length that is resonant such as an open-ended structure having an electrical length that is substantially equal to odd number of quarter-wavelengths; and reactive tuning devices (Z2 shown in FIG. 3 and discussed below) coupled to the ground resonator to increase the susceptance of existing devices such as a battery, for example.

The second type of device to divert currents is a second conductor 108 that presents a high impedance to RF currents and is used to divert currents away from itself and any dissipating media located proximally thereto. This device is made to have a high electrical impedance at the frequencies of operation by one of several means used alone or in combination. These means include: the use of small conductors, i.e. thin wires or conductors that have a width that is much narrower than the first conductor so as to increase inductance; a length that is anti-resonant such as an open-ended structure having an electrical length that is substantially equal to an even number of quarter-wavelengths; and reactive tuning devices (Z1 and/or 302 shown in FIG. 3 and discussed below) coupled between the printed circuit board and radiotelephone circuits (such as a battery, for example) that increase the impedance of existing devices such as keypads, displays, earpieces, shielding or any other part of the phone in close proximity to the user when operating the device.

Figure 2:
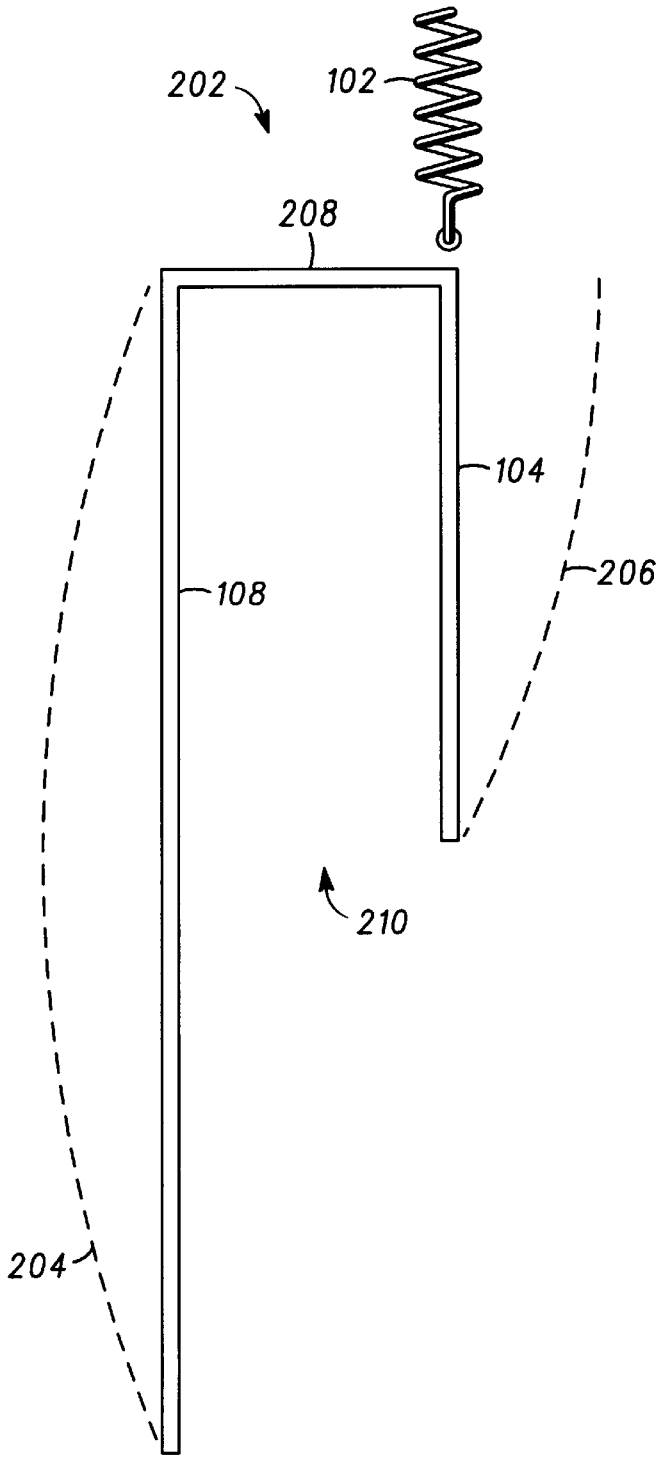
FIG. 2 is a side view of a first embodiment of the present invention of FIG. 1.

The quintessential implementation of the invention is illustrated in particular in FIG. 2. This diagram represents the essential parts of the antenna system of the present invention in a cross-sectional view. A substantially quarter-wavelength ground resonator 104 (counterpoise) is attached to the back side of a printed circuit board of a communication device, with a conductive connection 208 from the printed circuit board ground 108 to the resonator 104 made at the top edge 202 of the device. The ground resonator has an effective electrical length of about one-quarter wavelength, as indicated by the current magnitude distribution 206. A helical monopole antenna 102 is driven against this counterpoise (104). The length of the phone's main printed circuit board and associated ground plane 108 or appropriately chosen conductor provide an electrical length that is effectively about one-half wavelength at the operating frequency. This makes the printed circuit board and ground plane an antiresonant structure, as indicated by the current magnitude distribution 204 shown in the figure. As such, the antiresonant structure presents a high impedance to counterpoise currents flowing from the antenna 102 (i.e. its natural current distribution supports a current minimum at the top edge of the phone). The resonator 104, on the other hand, is a resonant form supporting the current magnitude distribution 206 shown in the figure having a maximum near the antenna. It should be recognized that the antenna 102 can be located anywhere on the conductive connection 208 between the first and second conductor 104, 108, with the appropriate adjustment to effective electrical length respectively, and not only on the furthest right portion as shown and preferred to reduce antenna exposure to a user.

The combination of the first and second conductors 104, 108 along with the air-filled volume 210 between the conductors can be viewed as a quarter-wave transmission line, which transforms the short at the top edge 202 to an open circuit at the bottom of the resonator 104 (i.e. an open, in circuit terms, that appears between the bottom end of the resonator and the printed circuit board. The antenna is driven near a first end of the transmission line. A quarter-wave conductor with an open at the bottom presents a low driving-point impedance to counterpoise currents flowing from the antenna 102 at the top, as illustrated by the current maximum at the top end of the resonator. As far as the resonator is concerned, it is decoupled from the rest of the phone so that from a radiation point of view its external length can be independently set to an optimum such that the antenna counterpoise currents preferentially flow on it instead of the printed circuit board. For the air-filled example given, this length also happens to be a quarter-wavelength. In summary, we can functionally differentiate an internal structure of the transmission line described above and an external structure of the outer surfaces of the supporting conductors 104, 108 that radiate currents generated by the antenna. The internal and external functionality both contribute to provide a combination of a high impedance to the printed circuit board 108 and a low impedance to the resonator 104 to cause most of the antenna counterpoise current to flow on the resonator 104, rather than on the printed circuit board. This leads to reduced dissipation in a user, and consequently reduced specific absorption rate (SAR) and increased radiation efficiency in the presence of the user.

EXAMPLE

An experimental antenna system was configured in accordance with the present invention, and as shown in FIG. 1, for a first configuration having the antenna mounted in the plane of the ground resonator. A second configuration was constructed that was identical with the exception of having the first conductor removed, i.e. no ground resonator. Both fixtures used helical monopoles that were individually impedance matched at the same frequency (approximately 835 MHz).

Figure 4:
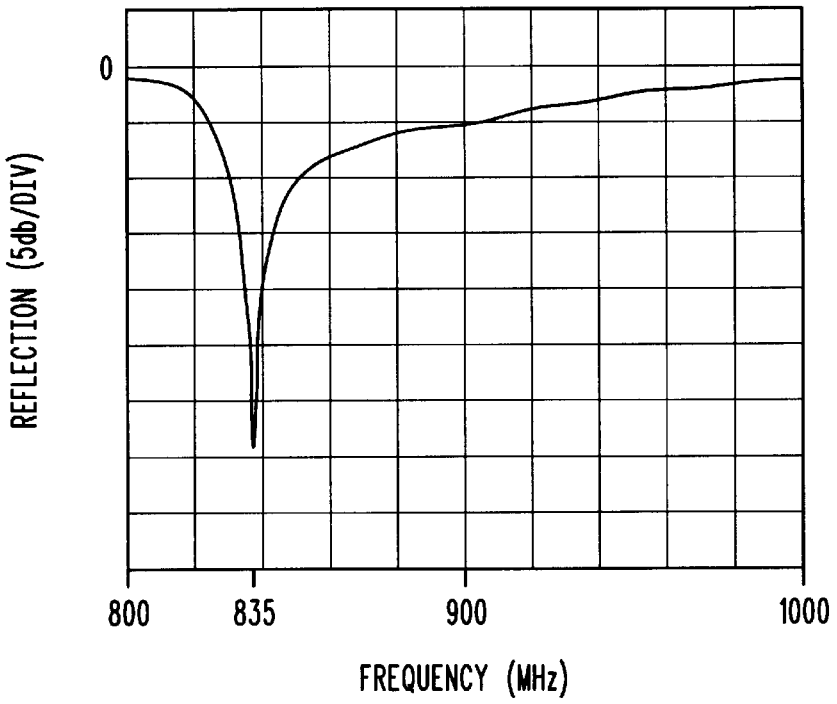
FIGS. 4–8 are a graphical representations of experimental evidence of the improvement provided by the present invention.
Figure 5:
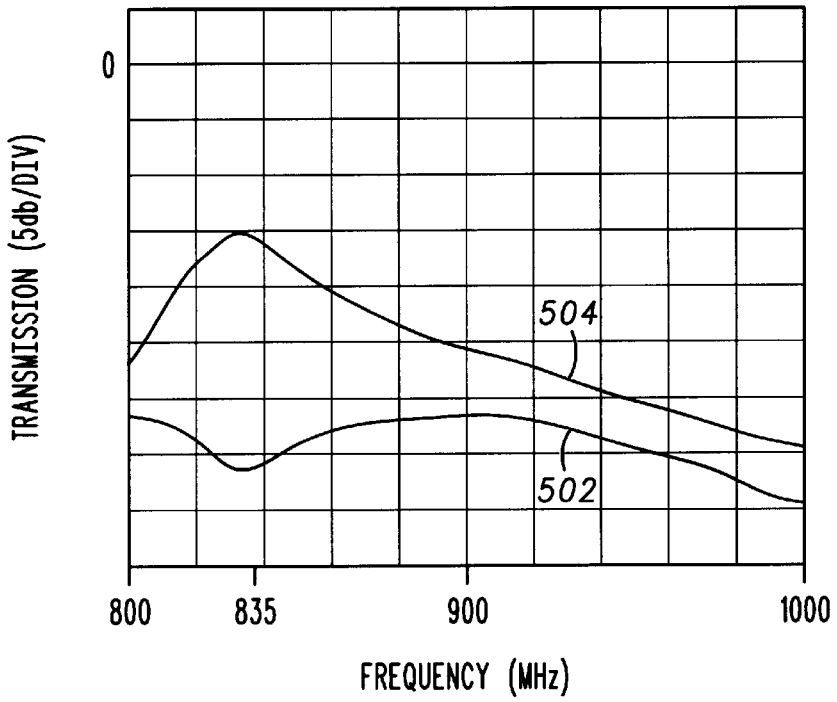

FIG. 4 shows a measured return loss of the antenna system with the ground resonator (monopole in plane of resonator). The graph clearly demonstrates that the RF power is being delivered to the antenna and is not diverted elsewhere. In other words, the antenna is well matched and is not reflecting power back to the source. FIG. 5 shows the measured currents on the front face of the printed circuit board and on the rear of the resonator. These currents were measured using a magnetic field probe. These plots show that the counterpoise currents have been drawn off of the printed circuit board (curve 502 having a lower magnitude) and onto the resonator (curve 504), with a magnitude difference of approximately 20 dB at the frequency of operation. In other words, the RF currents drawn away from a user by the present invention is two orders of magnitude lower. The significance of FIGS. 4 and 5 is that the improvement provided by the present invention is not due simply to power not being delivered to the antenna (as shown by the good match of FIG. 4) but is due to a fundamental difference in the radiating characteristics of the antenna along with the counterpoise system of the present invention (i.e. more of the delivered power is radiated instead of being dissipated in the user).

Figure 6:
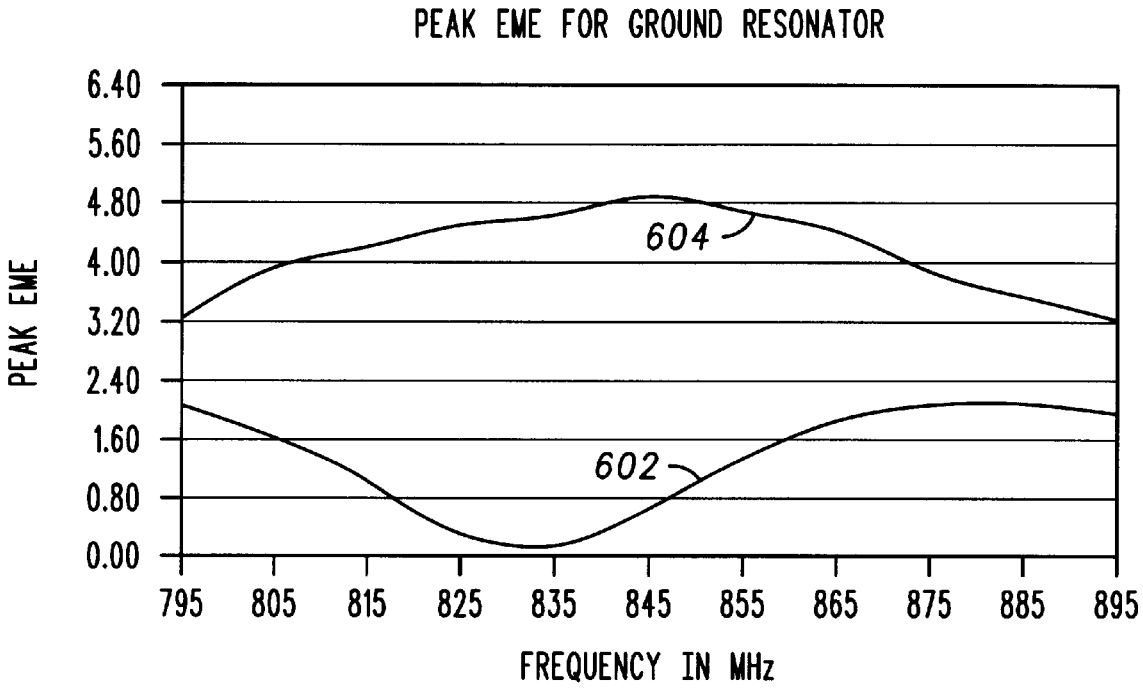
Figure 7:
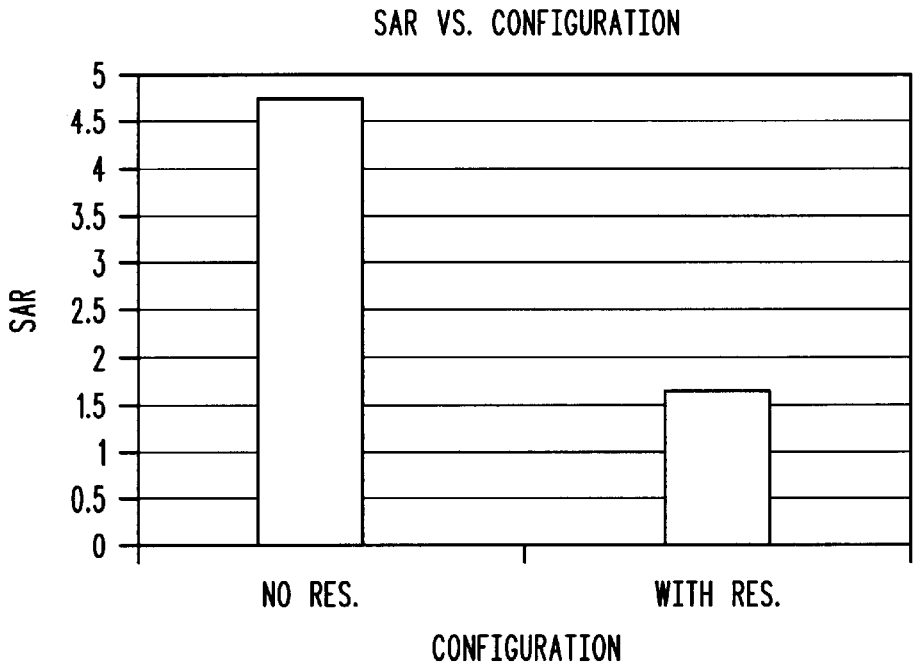
Figure 8:
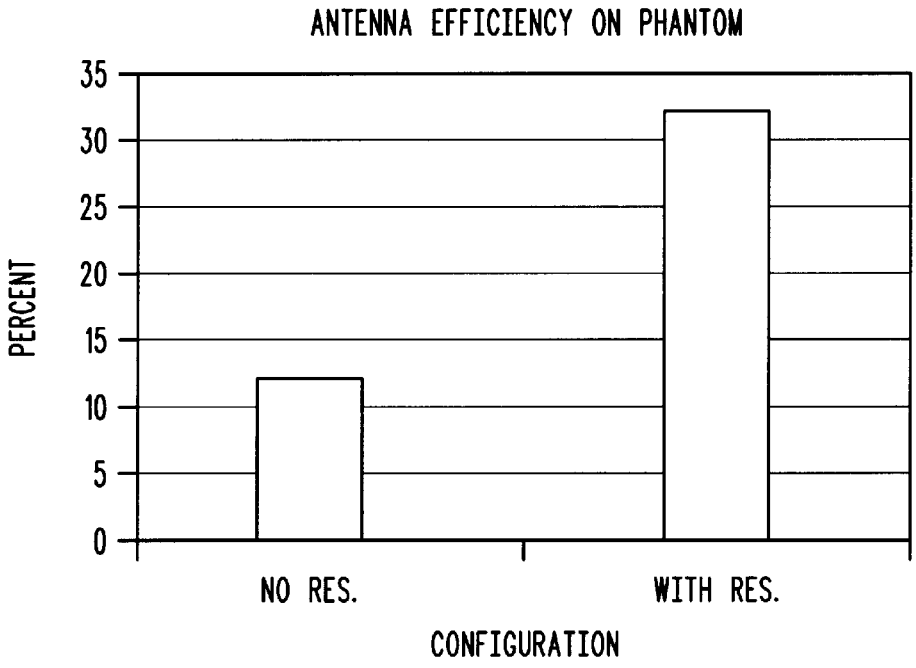

FIG. 6 illustrates the measured EME (electromagnetic exposure, a quantity related to SAR, measured in a phantom emulating the user as is known in the art) of the antenna configurations with (curve 602) and without (curve 604) the ground resonator. FIG. 7 shows the measured SAR and FIG. 8 shows the antenna efficiency of the two configurations, respectively, measured with the phone in a normal-use position at the head of a phantom that emulates the electrical properties of the user, as is well-known in the art. As can be seen, the use of the ground resonator in accordance with the present invention reduces EME and SAR while also improving efficiency (improved battery life). The operation of the present invention has also been validated via electromagnetic field simulation with similar results. In particular, it has been demonstrated that the field strength in the area of the phone near where the phone contacts a user's cheek (where the SAR peak typically occurs) is dramatically reduced.

Figure 3:
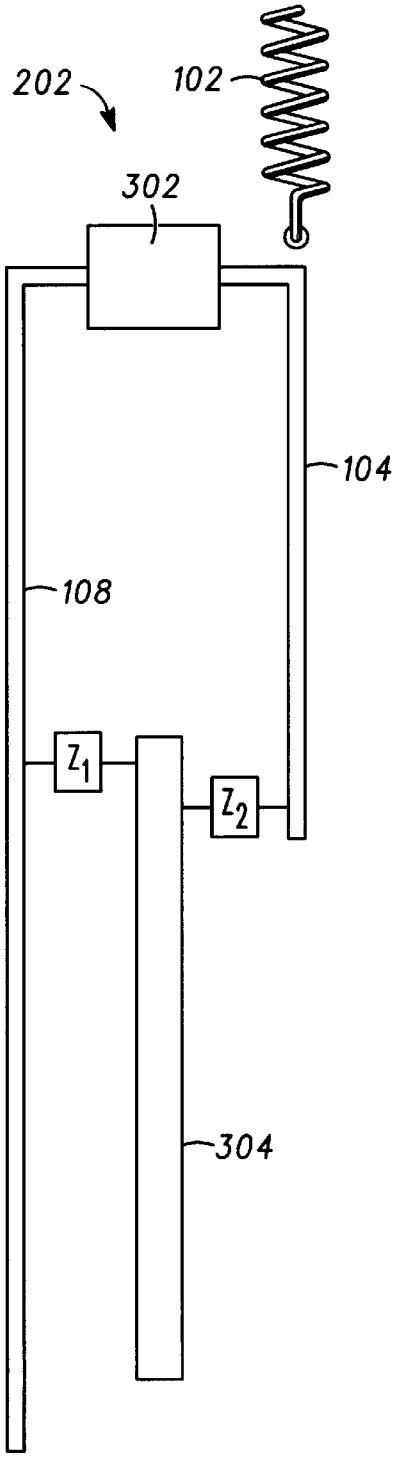
FIG. 3 is a side view of a second embodiment of the present invention.

In practice, it may be difficult to realize a printed circuit board with sufficient electrical length to achieve the desired resonance described above. Further, a phone contains a battery and other structures that complicate the implementation of the invention. FIG. 3 shows an enhanced embodiment of the present invention that overcomes these practical difficulties. Because the printed circuit board is typically shorter than the optimum length indicated in the first embodiment, due to reduced phone size requirements, an alternate means of providing the high impedance in this current path is provided. Any impedance device such as a lumped element balun 302 is thus used between the top of the ground resonator 104 (counterpoise) and the top 202 of the printed circuit board. The balun and printed circuit board (second conductor) together present an effective electrical length of about one-half wavelength such that a shorter printed circuit board can be utilized.

Because a battery 304 comprises a substantial conductor in a portable communication device, and because there can be insufficient room for a full-size quarter-wave counterpoise in many portable communication devices, the battery 304 can be used advantageously to load the counterpoise 104 to develop a proper overall resonance (low impedance path for currents from the antenna 102). This is accomplished by implementing and controlling reactive tuning devices (impedances Z1 and Z2), the components of which are implicit in the geometry of the phone as well as being separate components. The reactive device Z2 is tuned to increase susceptance with the battery load, and the reactive device Z1 is tuned to increase impedance with the battery load.

In experimental operation, it was determined that optimum performance was achieved in the target phone by having Z1 be a small inductance of about 2 nH, and Z2 is in fact a distributed reactance, of about 5 pF, created by a parallel-plate transmission line formed by the lower end of counterpoise 104 physically overlapping the battery 304. The actual values depend entirely on the size and shape of the battery and all the other conductors and is best determined experimentally. The main tuning goal is to adjust Z1 and Z2 to minimize magnetic field on the front conductor (108) surface at the operating frequency. It should be recognized that an overall design may also require some controlled impedance to be used in place of or in addition to the balun 302 at the top of the phone in order to optimize the reduction in EME. In addition, the connection of Z1 and Z2 between the battery and conductors need not be near the top of the battery as shown, but can be connected anywhere since iterative tuning is still needed. In the example shown, the connection used were already available as contacts of the battery. The structure in FIG. 3 has demonstrated similar performance improvements to those shown in the example above. However, the cost of reducing the length is a reduced bandwidth over which the improvement is seen. For very small phones, it may be necessary to make the impedances Z1 and Z2 actively tuned to overcome this bandwidth limitation.

An alternative configuration for reducing the sizes required for the resonator and printed circuit board is to make L-shaped conductors (shown as 114 and 116 in FIG. 1) or serpentine conductors. Depending on the length of the printed circuit board, it again may be necessary to use a balun to provide the high-impedance path to the printed circuit board.

In summary, it should be recognized that the present invention is a chassis-improvement technique. As such, its benefits apply to any sort of antenna element or exciter. A number of illustrations have been given using helical monopoles as the exciter, but the invention is equally applicable to other unbalanced antenna structures like printed wire antennas or planar inverted F antennas (PIFAs) as are known in the art.

It is to be understood that the phraseology or terminology employed herein is for the purpose of description and not of limitation. Accordingly, the invention is intended to embrace all such alternatives, modifications, equivalents and variations as fall within the broad scope of the appended claims.

What is claimed is:

1. A communication device with an improved antenna system, the device including a housing partially containing the antenna system along with a transceiver, the system comprising:

an antenna being electrically coupled to the transceiver;

a first conductor coupled to a ground connection near the antenna and being contained within the housing and located distally from such surfaces of the housing that can be held by or placed in proximity to a user, the first conductor presenting a low impedance at operating frequencies of the communication device such that RF currents are attracted onto the first conductor; and a second conductor coupled to the ground connection of the first conductor and being contained within the housing, the second conductor presenting a high impedance at operating frequencies of the communication device such that RF currents are diverted away from the second conductor.

2. The communication device of claim 1, wherein the first conductor is an open-ended structure having a length that is substantially equal to an odd number of quarter-wavelengths of an operating frequency of the communication device.

3. The communication device of claim 1, further comprising a first reactive tuning device coupled to the first conductor so as to increase susceptance.

4. The communication device of claim 3, wherein the first reactive device is coupled between the first conductor and radiotelephone circuits contained within the housing.

5. The communication device of claim 4, wherein the radiotelephone circuits includes at least one of the group of a battery and a printed circuit board.

6. The communication device of claim 1, wherein the second conductor has a width that is much narrower than the first conductor so as to increase inductance and a length that is anti-resonant with an operating frequency of the communication device.

7. The communication device of claim 6, wherein the second conductor is an open-ended structure having a length that is substantially equal to an even number of quarter-wavelengths of an operating frequency of the communication device.

8. The communication device of claim 1, further comprising a second reactive tuning device coupled to the second conductor so as to increase impedance.

9. The communication device of claim 8, wherein the second reactive device is coupled between the second conductor and radiotelephone circuits that would be located in close proximity to a user when operating the device.

10. The communication device of claim 9, wherein the radiotelephone circuits includes at least one of the group of shielding, a display, a keypad, and an earpiece.

11. A communication device with an improved antenna system, the device including a housing partially containing the antenna system along with a transceiver, the system comprising:

an antenna being electrically coupled to the transceiver;

a quarter wavelength transmission line with a first end located in proximity to the antenna, the transmission line comprising;

a first conductor coupled to the first end of the transmission line and being contained within the housing and located at an upper rear portion of the housing, the first conductor being substantially resonant so as to present a low impedance at operating frequencies of the communication device such that RF currents are attracted onto the first conductor; and a second conductor shorted to the first conductor at the first end of the transmission line and being contained within the housing, the second conductor being substantially anti-resonant so as to present a high impedance at operating frequencies of the communication device such that RF currents are diverted away from the second conductor, the transmission line transforms a short at the first end to an open circuit at a second end of the first conductor so as to present a low driving-point impedance to counterpoise currents flowing from the antenna.

12. The communication device of claim 11, wherein the first conductor is an open-ended structure having a length that is substantially equal to an odd number of quarter-wavelengths of an operating frequency of the communication device.

13. The communication device of claim 11, further comprising a first reactive tuning device coupled between the first conductor and a battery, the first reactive device being tuned to increase susceptance with the battery load.

14. The communication device of claim 11, wherein the second conductor is an open-ended structure having a length that is substantially equal to an even number of quarter-wavelengths of an operating frequency of the communication device.

15. The communication device of claim 11, further comprising a second reactive tuning device coupled between the second conductor and a battery, the second reactive device being tuned to increase impedance with the battery load.

16. The communication device of claim 11, further comprising a first reactive tuning device coupled between the first conductor and a battery and a second reactive tuning device coupled between the second conductor and the battery, the first reactive device being tuned to increase susceptance with the battery load and the second reactive device being tuned to increase impedance with the battery load.

17. The communication device of claim 11, wherein the antenna is a helical monopole driven near the first end of the transmission line.

18. The communication device of claim 11, wherein the second conductor is a printed circuit board of the communication device having an effective electrical length of about one-half wavelength.

19. A communication device with an improved antenna system, the device including a housing partially containing the antenna system along with a transceiver, the system comprising:

an unbalanced antenna being electrically coupled to the transceiver;

a quarter wavelength transmission line with a first end located in proximity to the antenna, the transmission line comprising;

a first conductor coupled to a first end of the transmission line and being contained within the housing and located at an upper rear portion of the housing, the first conductor having an electrical length of about one-quarter wavelength so as to be substantially resonant and present a low impedance and a high susceptance at operating frequencies of the communication device such that RF currents are attracted onto the first conductor; and a second conductor coupled to the first conductor at the first end of the transmission line and being contained within the housing, the second conductor having an electrical length of about one-half wavelength so as to be substantially anti-resonant and present a high impedance at operating frequencies of the communication device such that RF currents are diverted away from the second conductor, the transmission line transforms the coupling at the first end to an open circuit at a second end of the first conductor so as to present a low driving-point impedance to counterpoise currents flowing from the antenna.

20. The communication device of claim 19, further comprising a balun coupled between the first and second conductors, the balun and second conductor together presenting an effective electrical length of about one-half wavelength such that a shorter printed circuit board can be utilized.

* * * * *